US005299846A

United States Patent [19]

Rush

[11] Patent Number: 5,299,846

[45] Date of Patent: Apr. 5, 1994

[54] GOLF CLUB BALL EXTRACTORS

[76] Inventor: Robert M. Rush, 1559 Breese St., NE., Palm Bay, Fla. 32905

[21] Appl. No.: 69,190

[22] Filed: Jun. 1, 1993

Related U.S. Application Data

[63] Continuation of Ser. No. 878,929, May 6, 1992, abandoned.

[51] Int. Cl.[5] ..... A63B 47/02

[52] U.S. Cl. ..... 294/19.2; 273/162 E

[58] Field of Search ..... 294/19.1, 19.2, 99.1; 273/32 B, 32 F, 162 E

[56] References Cited

U.S. PATENT DOCUMENTS

| | | | |
|---|---|---|---|
| 802,264 | 1/1905 | Brown . | |
| 1,380,526 | 6/1921 | Carpenter . | |
| 1,674,294 | 7/1928 | O'Rourke . | |
| 1,830,520 | 11/1931 | Moyses | 294/19.2 |
| 2,154,989 | 4/1939 | Moore | 294/19.2 |
| 2,432,906 | 12/1947 | Klingler | 294/19.2 |
| 2,523,942 | 9/1950 | Ciambriello | 294/19.2 |
| 2,750,222 | 6/1956 | Borah | 294/19.2 |
| 2,801,875 | 2/1955 | McEvoy | 294/19.2 |
| 2,819,109 | 1/1958 | Borah | 294/19.2 |
| 2,833,584 | 5/1958 | McEvoy | 294/19.2 |
| 3,136,573 | 6/1964 | Harke | 294/19.2 |
| 3,239,264 | 3/1964 | DuPont | 294/19.2 |
| 3,273,927 | 3/1965 | Carlson | 294/19.2 |
| 3,318,628 | 1/1964 | White | 294/19.2 |
| 3,401,970 | 8/1966 | Russell | 294/19.2 |
| 3,442,544 | 5/1969 | Faber | 294/19.2 |
| 3,462,184 | 8/1966 | Russell | 294/19.2 |
| 3,698,720 | 11/1972 | Gudmundsen | 273/162 E |
| 3,922,026 | 11/1975 | Schweitzer | 294/19.2 |
| 4,313,632 | 2/1982 | King et al. | 294/19.2 |
| 4,687,204 | 8/1987 | Lempio | 273/162 E |
| 4,787,632 | 11/1988 | Nigrelli et al. | 273/32 B |
| 4,846,515 | 7/1989 | Hall, Sr. | 294/19.2 |
| 5,004,240 | 4/1991 | Tsukamoto | 273/162 E |

FOREIGN PATENT DOCUMENTS

| | | | |
|---|---|---|---|
| 207138 | 11/1923 | United Kingdom | 294/19.2 |
| 770198 | 3/1957 | United Kingdom | 294/19.2 |
| 2128484 | 5/1984 | United Kingdom | 294/19.2 |
| 8404627 | 11/1984 | World Int. Prop. O. | 294/19.2 |

*Primary Examiner*—Dean J. Kramer
*Attorney, Agent, or Firm*—Edward M. Livingston

[57] ABSTRACT

A ball extracting device (1, 14) for removing a golf ball (8) from holes and other locations which is integrally attachable to a golf club shaft (3) on the grip (13) of a golf club. The device is a cylindrically-shaped module having side walls (18), a bottom (19) and an open top (7) for extracting and retaining a golf ball (8) when downward pressure is applied to the device (1, 14) against the ball (8). The walls (18) contain holes (5) therethrough so that a golfer's fingers can be inserted to facilitate easy removal of the ball from the device. The extracting device (1, 14) can be incorporated either with a replacement grip (2) that fits over the shaft of a golf club, a grip that covers a preexisting grip, or a cap-like module (14) that fits over the end of a golf club grip. All versions of the device work in the same manner and do not require modification to the existing golf club. This device eliminates the need for stressful bending when extracting golf balls from holes or other places, particularly for handicapped golfers, golfers with back problems, elderly golfers, or those with medical conditions such as arthritis.

8 Claims, 3 Drawing Sheets

GOLF CLUB BALL EXTRACTORS

CROSS-REFERENCE TO RELATED APPLICATION

This is a continuation of application Ser. No. 07/878,929, filed May 6, 1992 now abandoned.

BACKGROUND OF THE INVENTION

This invention relates generally to golfing, and more particularly to golf ball retrieving and extracting devices that fit or attach to golf clubs.

Normally, at the completion of each hole golfers must bend over to remove a golf ball from the cup. Also, oftentimes during play golfers may have to bend over numerous times to remove golf balls from hazards, such as grass or water. Although bending over is usually not a problem for the young golfer, it can be a strenuous and virtually impossible task for the elderly, anyone with back problems, arthritis, or a handicapped golfer. Thus, there is a need for a device that will extract golf balls from such locations without requiring the golfer to bend over.

Furthermore, such a ball extracting device must be convenient and easy to use as usually a golfer carries only the putter in hand at the end of the hole or, if not a that hole, the golfer carries another club and is separated from the golf bag. Therefore, it is necessary to have such a device that is built into the putter or club which, at the same time, does not effect the playing characteristics of the putter or club.

The prior art contains many devices designed to fulfill the above needs, but none does it like the present invention. The most pertinent patents concerning golf ball retrievers or extractors that attach to the handle-grip end of a golf club are as follows:

| U.S. Pat. No.: | Inventor: | Date of Patent: |
|---|---|---|
| 5,004,240 | Tsukamoto | April 2, 1991 |
| 4,787,632 | Nigrelli, et al. | Nov. 29, 1988 |
| 3,318,628 | White | May 9, 1967 |
| 3,401,970 | Russell | Sept. 17, 1968 |
| 3,462,184 | Russell | Aug. 19, 1969 |
| 2,833,584 | McEvoy | May 6, 1958 |
| 2,801,875 | McEvoy | Aug. 6, 1957 |
| 802,264 | Brown | Oct. 17, 1905 |
| 3,698,720 | Gudmundsen | Oct. 17, 1972 |
| 3,273,927 | Carlson | Sept. 20, 1966 |
| 3,239,264 | DuPont | March 25, 1964 |
| 4,687,204 | Lempio | Aug. 18, 1987 |
| 1,380,526 | Carpenter | June 7, 1921 |
| 1,674,294 | O'Rourke | June 19, 1928 |
| 2,523,942 | Ciambriello | Sept. 26, 1950 |
| 2,750,222 | Borah | June 12, 1956 |

The Tsukamoto patent shows an extractor will ball-retrieving prongs built into the grip handle. Unfortunately, the latter device requires that the golf club handle be modified so that a spring and other mechanical components can be placed therein to operate the retrieving prongs. The Nigrelli, et al. patent shows claw-clamp type retrievers that attach to the end of a club handle. The White patent shows another prong-like retriever built into the handle grip operable by a push button extension. The two Russel patents show other prong-like retrievers that attach to the end of a handle or which are built into the handle grip extension. The two McEvoy patents also show palm retrievers that are removably attachable to the handle by different means. The remainder of the above patents show various golf ball retrievers that fit by a collar over the end of the golf club or are incorporated within the handle grip itself.

Unlike the golf ball retrievers or extractors in the prior art that are attached to the handle end of the golf club, the present invention is an integral part of the grip itself and thus requires no modification of an existing golf club. Furthermore, unlike inventions in the prior art the present invention has no moving parts. The present invention discloses an extractor which is a circular module having an opening on the top end which holds a ball when it is pushed downward on the ball. The present extractor has one or more finger holes around the extractor to enable the ball to be released from the extractor by use of the golfer's fingers. One embodiment of the present invention has an entire grip that fits over the golf club shaft and replaces the preexisting grip on the golf club. Another embodiment is designed to fit over a preexisting grip. Finally, a third embodiment attaches just over the tip of the grip itself. All of the embodiments require no modification to existing golf clubs and have no impact upon putting or playing performance.

SUMMARY OF THE INVENTION

The primary object of the present invention is to provide a device which extracts balls from golf hole cups or other locations, such as deep grass.

Another object of the present invention is to provide such a device that eliminates the need to bend over when extracting or retrieving balls, a particularly acute problem for the handicapped, the elderly and anyone with back problems, arthritis or other medical condition affecting the back.

Another object of the present invention is to provide such a device that requires no modification to existing golf clubs, such that it can be used easily to retrofit current putters or other golf clubs.

Another object of the present invention is to provide such a device that is attachable to a golf putter or club in a manner that does not affect the playing characteristics of the putter or club.

An even further object of the present invention is to provide such a device that is convenient and easy to use.

The present invention fulfills the above and other objects by providing a device for extracting golf balls from holes and other places which attaches to the handle-grip end of the golf club. The device is a circular-shaped module which has side walls with an opening at the top end for receiving a golf ball. The opening has a diameter slightly less than that of a golf ball and is flexible such that upon the exertion of pressure against the ball, the device allows the ball to enter into an internal cavity between the walls and be retained therein. The device contains one or more holes through and around the walls so that the ball can then be removed by sticking one's fingers through the walls under the ball and inserting a slight outward pressure to force the ball out through the opening. The device can be attached to a golf club by various means: at the bottom of the module by an entire elongated grip which has an internal cavity just large enough to fit over the shaft of a golf club in cases when it is used to replace a preexisting grip; over an entire preexisting grip so the grip does not have to be removed before utilizing same; or over the top of the preexisting grip on the golf club.

The extracting device of the present invention is preferably utilized on putter's but is attachable to any golf club. It may be placed on a regular golf club having a regular hitting head or a golf club with an extracting device also on the head itself.

The above and other objects will become even more readily apparent when a detailed description of the preferred embodiments of the invention are described in conjunction with the drawings as set forth hereinbelow.

BRIEF DESCRIPTION OF THE DRAWINGS

The drawing figures used to illustrate the preferred embodiments of the invention are as follows.

DESCRIPTION OF THE PREFERRED EMBODIMENTS

Figure 1:
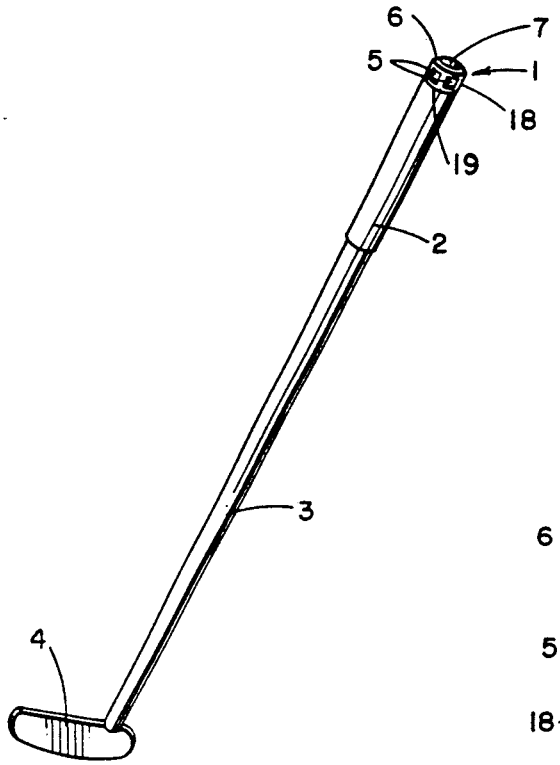
FIG. 1 is a perspective view of a golf club containing the extracting device which is the subject of this invention.

Referring now to the drawings, in FIG. 1 the extractor device 1 is shown mounted to a golf club handgrip 2 which, in turn, is mounted on the shaft 3 of the golf club attached to a putter head 4. As shown, the extractor device 1 contains an opening mouth 7 on its top end with an outwardly-slanted gripper portion 6.

Figure 2:
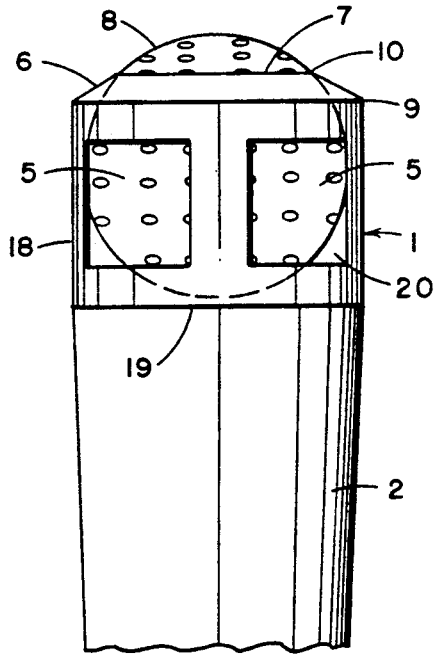
FIG. 2 is an enlarged side plan view of the extracting device with a golf ball contained therein.

As shown more clearly in FIG. 2, when pressed downward on a golf ball 8, the golf ball 8 passes through the open mouth 7 until it lodges within the extracting device 1. The slanted gripper portion 6 helps to prevent the ball 8 from coming back out of the extractor by itself. Finger-holes 5 are provided though the walls 18 of the extracting device in order that the golfer may insert his or her fingers through said holes 5 and, by exerting outward pressure on the ball, dislodge it through the opening mouth 7 so that the golf ball 8 may be reused.

Figure 3:
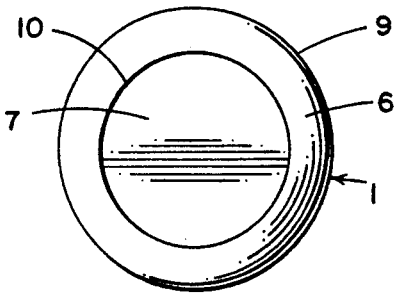
FIG. 3 is a top end vie of the extracting device itself.

The top view of the extracting device shown in FIG. 3 shows the inner circumference 10 of the mouth 7, the slanted gripper portion 6 and the outer circumference of the extractor 9. The extracting device could be used in other sports, such as baseball, where such a device could be attached to the end of a bat. However, regardless of the sport in which it is used, the dimensions of the device in relation to the ball are important to its operation. For instance, the diameter of the inner circumference 10 must be slightly less then the diameter of the ball, in this present case, a golf ball 8. The extracting device 1 itself must be made of a firm, but flexible and resilient material, such as a rigid polymer, to allow the ball 8 to be pressed through the open mouth 7 by the inner circumference 10 and into the internal cavity 20 of the extracting device 1.

More specifically, for a standard golf ball, the dimensions of the extractor which have been shown to work are as follows: diameter of the opening mouth 7 is 1 21/32 inches; diameter of the outer circumference 9 is 1 25/32 inches; slanted portion 6 is ¼ inch; length from the top of the mouth 7 to the bottom 19 is 1½ inches. Of course, if the extracting device is utilized with other balls in other sports, then the measurements would vary accordingly, but the same principal would apply, that is, the diameter of the opening mouth 7 is going to be slightly less than the diameter of the ball itself.

Figure 4:
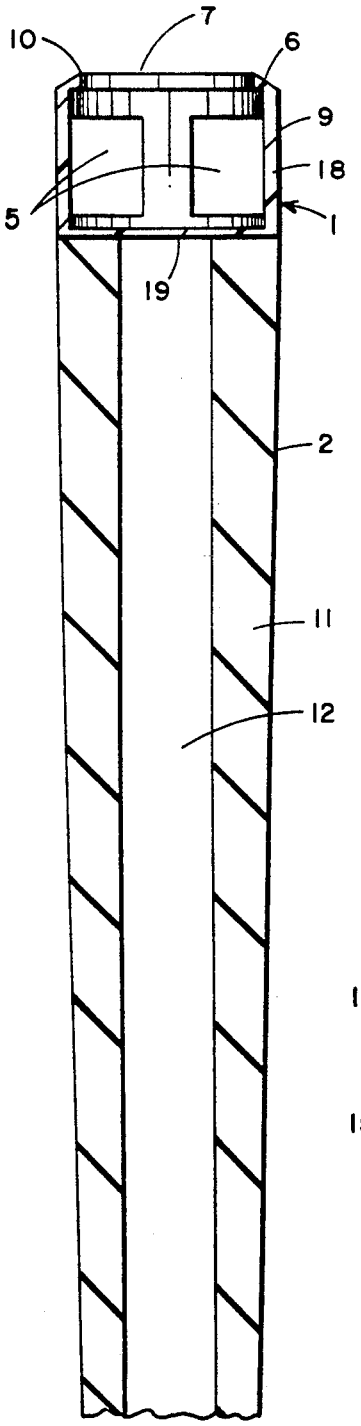
FIG. 4 is a side cross-section view of the extracting device as part of a replacement grip.

Referring to FIG. 4, the extracting device 1 is shown incorporated into a replacement handgrip 2. In this embodiment, the replacement grip, is made of neoprene or similar material, common to golf club handgrip as indicated in crosssection 11, contains a central cavity 12 which is sized to fit over the shaft 3 of the golf club.

Figure 5:
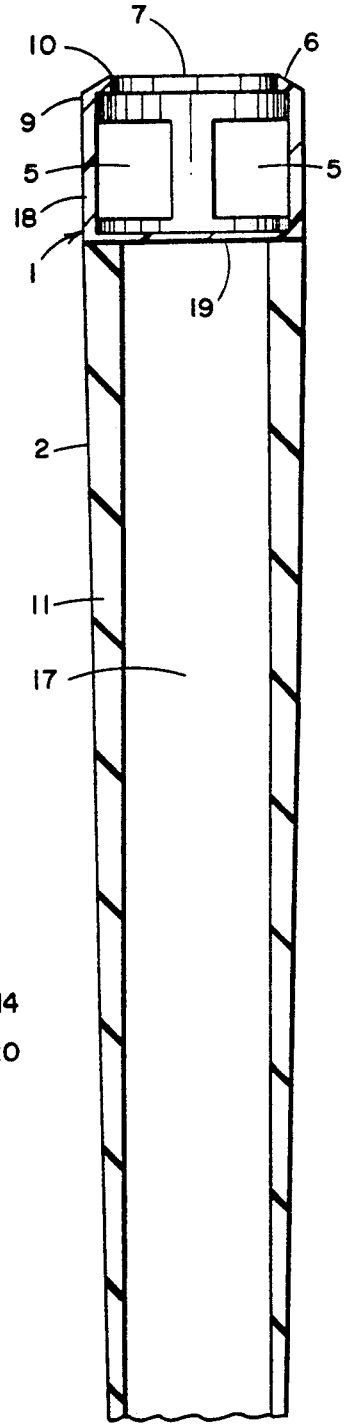
FIG. 5 is a side cross-section view of the extracting device with a grip that covers the entire preexisting grip on a golf club.

In FIG. 5 the extracting device 1 is shown attached to the grip 2. This embodiment contains a wider cavity 17 so that the entire grip 2 can fit over the preexisting golf club grip without requiring that it be removed such as the embodiment in the invention if FIG. 4.

Figure 6:
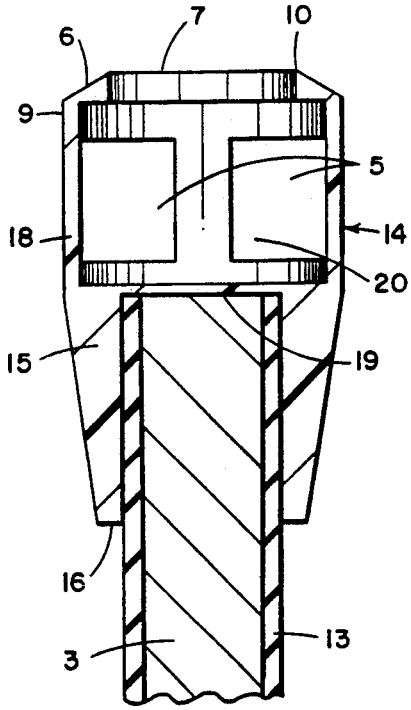
FIG. 6 is a side cross-section view of the extracting device which fits on the top end of the golf club over the preexisting grip.

FIG. 6 shows another embodiment of the invention taking the form of an extractor attachment 14 which fits over the top of an existing grip 13. It is attached to the grip 2 by a short-sleeved portion 15 having a bottom which extends around the grip 13 to hold the extractor 14 securely to the top of the golf club. This embodiment may be removably attachable to a club for those golfers who prefer to attach it only as needed. It would be small enough to be carried in a golfer's pocket and would probably be more popular with the golfing "purest" who would desire not to have anything attached to a golf club even though this particular invention would not affect the play of the golfer or playing characteristics of the golf club.

Figure 7:
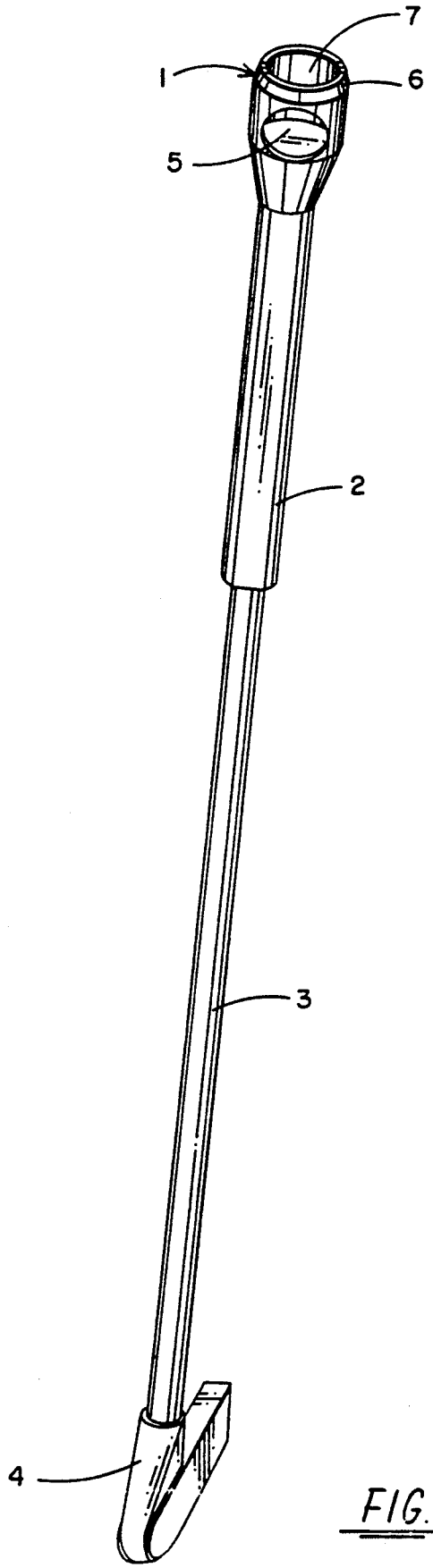
FIG. 7 is a perspective view of a golf club containing a different embodiment of the extracting device.

FIG. 7 depicts the extractor 1 with one hole 5 into which only one finger need be inserted to remove a golf ball. This embodiment has the same features as prior drawings consisting of a mouth 7, flexible slanted griper portion 6 having a diameter slightly smaller than a golf ball, a hand grip 2, shaft 3 and putter head 4.

Although only a few embodiments of the present invention have been described in detail hereinabove, it should be apparent that a novel and non-obvious new extracting device for use in golfing and other sports has been provided by this invention which has numerous advantages over the prior art. Among these advantages are that it requires no modification to existing golf clubs nor does it have any moving parts which can break down. Furthermore, the extracting device, which is the subject of this invention, can be incorporated with golf club grips to serve as a replacement grip, a covering grip or can be made by itself simply to fit over the top of the golf club handle. Thus, any golfer with back problems, arthritis, who is elderly or who is handicapped will find this invention most useful in extracting balls from golf hole cups or other locations.

Not only will this new golfing invention surely bring back some pleasure to golfing for handicapped or infirm persons, but it will also be appreciated by all golfers, both men and women, professionals or amateurs, alike who will find this product new and useful.

Although only certain embodiments of the present invention have been described and illustrated hereinabove, all variations, improvements and modifications of this device within the scope or equivalents of the claims are included in this invention.

Having thus described my invention, I claim the following:

1. A device for extracting a gold ball from holes and other places which is attachable to the grip-handle end of golf club comprising:

a cylindrically-shaped module having side walls and an opening facing outwardly on the top end for receiving a gold ball, said opening having a diameter slightly less than that of the ball and having a continuous bevel at the top of said side walls, said bevel being slanted outwardly and downwardly from said openings was inserted after the word to an outer diameter slightly more than a diameter of a golf ball, said module having an internal cavity between the walls which is sufficiently large enough to completely encompass and hold a golf ball, said module having at least one hole through its walls so that fingers can be inserted to push outward on the ball to remove the ball from the module as desired; and means for attaching the module to a golf club, said means being situated at the bottom of said module.

2. The device of claim 1 wherein the means for attaching the module to a golf club comprises an elongated cylindrical grip at the bottom of the module, said grip having walls surrounding an interior cavity along its length, said cavity being sized such that it fits over a shaft of a golf club and replaces a preexisting grip on the golf club.

3. The device of claim 1 wherein the means for attaching the module to a golf club comprises an elongated cylindrical sleeve at the bottom of the module, said sleeve having walls surrounding an interior cavity along its length, said cavity sized such that it fits over a preexisting grip on the club.

4. The device of claim 1 wherein the means for attaching the module to a golf club comprises a short cylindrical grip having walls surrounding an interior cavity which is sized such that it fits securely over the end of a preexisting golf grip.

5. The device of claims 1, 2, 3 or 4 wherein the module is made of a resilient, but flexible, material.

6. The device of claims 1, 2 or 3 wherein the means for attaching the module to a golf club is made of a elastic-rubberized material to fit firmly over the handle of a golf club.

7. The device of claims 1 and 2 wherein the module and the means for attaching it to a golf club are integrally formed with a grip on the golf club.

8. The device of claim 1, 2, 3, or 4 wherein the module has a plurality of holes through its walls so that fingers can be inserted to push outwardly on the ball to remove the ball from the module as desired.

* * * * *